US005967128A

United States Patent [19]

Onuki et al.

[11] Patent Number: 5,967,128

[45] Date of Patent: Oct. 19, 1999

[54] IGNITION APPARATUS FOR AN INTERNAL COMBUSTION ENGINE

[75] Inventors: Hiroshi Onuki; Takashi Ito, both of Hitachinaka; Katsuaki Fukatsu, Naka-gun; Ryoichi Kobayashi, Tokai-mura; Noboru Sugiura, Miro, all of Japan

[73] Assignee: Hitachi, Ltd. & Hitachi Car Engineering Co., Japan

[21] Appl. No.: 09/083,139

[22] Filed: May 22, 1998

[30] Foreign Application Priority Data

May 26, 1997 [JP] Japan ..... 9-134904

[51] Int. Cl.[6] ..... F02P 3/05; F02P 3/055

[52] U.S. Cl. ..... 123/644; 123/651

[58] Field of Search ..... 123/630, 644, 123/651; 315/209 T

[56] References Cited

U.S. PATENT DOCUMENTS 5,500,619 3/1996 Miyasaka ..... 327/427

5,664,550 9/1997 Ito et al. ..... 123/630

5,723,916 3/1998 Disney et al. ..... 123/630 X 5,775,310 7/1998 Ito et al. ..... 123/644

*Primary Examiner*—Tony M. Argenbright

*Attorney, Agent, or Firm*—Evenson, McKeown, Edwards & Lenahan, P.L.L.C.

[57] ABSTRACT

According to the invention, a primary winding of an ignition coil is coupled with an insulated-gate bipolar transistor (IGBT). The IGBT is controlled by a current restriction circuit, which includes a control transistor for performing the on-off operation of the IGBT such that the IGBT is made conductive upon occurrence of an ignition control signal, and nonconductive, when a primary current of the ignition coil reaches a certain value depending on a reference voltage determined by a bias circuit. The bias circuit has a condenser, which is charged by a base current of the control transistor to change the base potential of the transistor slowly, when the transistor is made nonconductive.

10 Claims, 7 Drawing Sheets

GATE VOLTAGE OF IGBT

PRIMARY CURRENT OF IGNITION COIL

COLLECTOR VOLTAGE OF IGBT

VOLTAGE OF RESISTOR 22

BASE VOLTAGE OF TRANSISTOR 33

SECONDARY VOLTAGE OF IGNITION COIL

GATE VOLTAGE OF IGBT

PRIMARY CURRENT OF IGNITION COIL

COLLECTOR VOLTAGE OF IGBT

SECONDARY VOLTAGE OF IGNITION COIL

IGNITION APPARATUS FOR AN INTERNAL COMBUSTION ENGINE

BACKGROUND OF THE INVENTION

1. Field of the Invention

The present invention relates to an ignition apparatus for an internal combustion engine, and more particularly to an ignition apparatus which uses an insulated-gate bipolar transistor (called IGBT, hereinafter) as a switching element.

2. Description of the Related Art

Referring at first to FIG. 6, brief description will be made of a typical one of conventional ignition apparatuses for an internal combustion engine using an IGBT as a switching element, hereinbelow.

An output circuit of electronic control unit (ECU) 1 is constructed by PNP transistor 9, NPN transistor 10 and resistor 11. The transistors 9, 10 alternately repeat the switching operation in response to the signals obtained by computer (CPU) 8, whereby the pulse-like voltage as an ignition control signal is produced to ignition device 2.

The ignition device 2 comprises hybrid IC 19 and IGBT 21. The hybrid IC 19 is composed of resistor 16 for detecting a primary current of ignition coil 20, transistor 17 for restricting the primary current of the coil 20 to a set value by its base potential being controlled, and input resistor 18. IGBT 21 repeats the on-off operation to control the current flowing through a primary winding of the ignition coil 20. Further, $V_B$ indicates a battery terminal and reference numeral 14 denotes high voltage diode inserted between a secondary winding of the ignition coil 20 and a spark plug (not shown) for preventing a reverse voltage appearing when the primary current begins to flow.

FIGS. 7*a* to 7*d* show waveforms of voltage or current at various parts of the circuit as shown in FIG. 6. Thereamong, FIG. 7*a* denotes a waveform of an ignition control signal applied to a gate of IGBT 21 (i.e. IGBT gate by voltage), FIG. 7*b* that of the primary current flowing through the ignition coil 20, FIG. 7*c* that of a collector voltage of IGBT 21 and FIG. 7*d* that of a secondary voltage of the ignition coil 20.

When ECU 1 produces the ignition control signal as shown in FIG. 7*a* to a gate of IGBT 21, the primary current as shown in FIG. 7*b* begins to flow. When the primary current increases and the voltage drop across the resistor 16 reaches the operating voltage of the transistor 17, the transistor 17 becomes conductive to thereby decrease the gate voltage of IGBT 21. As a result, IGBT 21 is kept in the active state and the collector voltage thereof rises as shown in FIG. 7*c*, whereby the primary current of the ignition coil 20 is maintained constant. Namely, the primary current is ready to enter into the saturation condition.

In this circuit as shown in FIG. 6, however, the voltage between the collector and the emitter of IGBT 21 jumps at the beginning of the primary current being restricted, i.e., just before the saturation thereof, because of the relationship of the phase delay in the gate control and the gain of IGBT 21. Accordingly, the primary current flowing through the ignition coil 20 also jumps as indicated by $B_1$ in FIG. 7*b*, whereby the severe vibration occurs in the voltage between the collector and the emitter as indicated by $C_1$ in FIG. 7*c*. It becomes more severe according to an ignition coil used, when the gain of IGBT 21 increases because of the temperature rise.

Since the primary current jumps and then swings as shown by $B_1$ in FIG. 7*b*, a voltage is induced in the secondary winding of the ignition coil 20, as shown by $D_1$ in FIG. 7*d*. If this voltage $D_1$ is high enough, an undesirable spark occurs in a spark plug before the regular spark caused by the secondary voltage $D_2$ at the proper timing.

To improve such a problem as mentioned above, an ignition apparatus as shown in JP-A 6-53795 is proposed. Referring again to FIG. 6, brief explanation about this prior art will be done, hereinbelow. The ignition apparatus of this prior art is provided with a damper resistor between the gate of IGBT 21 and the juncture of the collector of the transistor 17 and the resistor 18. With such a damper resistor, the response of the IGBT is lowered, whereby the current flowing therethrough is restricted stably.

In the case, however, where an IGBT is connected on the side of an ignition coil, which is low in the potential, i.e., on the side opposite to the battery side, the damper resistor can not suppress the jump of the current sufficiently. Further, since the responsibility of the IGBT is lowered, this prior art is not suited for the high speed switching operation. Moreover, there was a problem that the sufficiently high secondary voltage could not be obtained, because the current cutting-off speed is decreased due to the gate capacitance of the IGBT.

Furthermore, there was a problem as follows. That is, if the gain of the IGBT becomes large because of the temperature rise, for example, the jump or vibration in the collector voltage is increased, whereby the primary current also jumps or vibrates and hence the undesirable high voltage is induced in the secondary winding of the ignition coil.

SUMMARY OF THE INVENTION

An object of the present invention is to provide an ignition apparatus for an internal combustion engine, which uses an IGBT as a switching element and can prevent a primary current of an ignition coil and a collector voltage of the IGBT from jumping or swinging, when the current flowing through the IGBT is ready to be saturated.

A feature of the present invention resides in an ignition apparatus for an internal combustion engine, having: an ignition coil; an IGBT for performing the switching control of a primary current of the ignition coil; an electronic control unit for supplying an ignition control signal for a gate of the IGBT to make it carry out the switching operation; and current control means for restricting the ignition control signal in accordance with the primary current of the ignition coil, characterized in that the current control means comprises: a transistor for rendering the IGBT conductive upon occurrence of the ignition control signal, when the transistor is in the low impedance state, wherein the transistor being made the high impedance state, when the primary current of the ignition coil reaches a certain value; a bias circuit for providing a bias voltage to keep a base of the transistor at a predetermined potential, by which the transistor is made the low impedance state; and a condenser, which is connected to the base of the transistor and changes the base potential of the transistor with a certain time constant, when the transistor is made the high impedance state.

According to another feature of the present invention, the current control means further includes a second transistor which becomes nonconductive, when the transistor is in the low impedance state, and conductive to ground the gate of the IGBT, when the transistor is in the high impedance state, and a feed-back circuit provided between the base of the second transistor and the bias circuit.

According to still another feature of the present invention, the bias voltage is controlled by a variable voltage source generated in the electronic control unit.

According to further feature of the present invention, the ignition apparatus is further provided with an abnormality detection circuit and the bias voltage is controlled by an output of the abnormality detection circuit.

DETAILED DESCRIPTION OF THE PREFERRED EMBODIMENTS

In the following, description will be done of preferred embodiments of the present invention, referring to the accompanying drawings.

Figure 1:
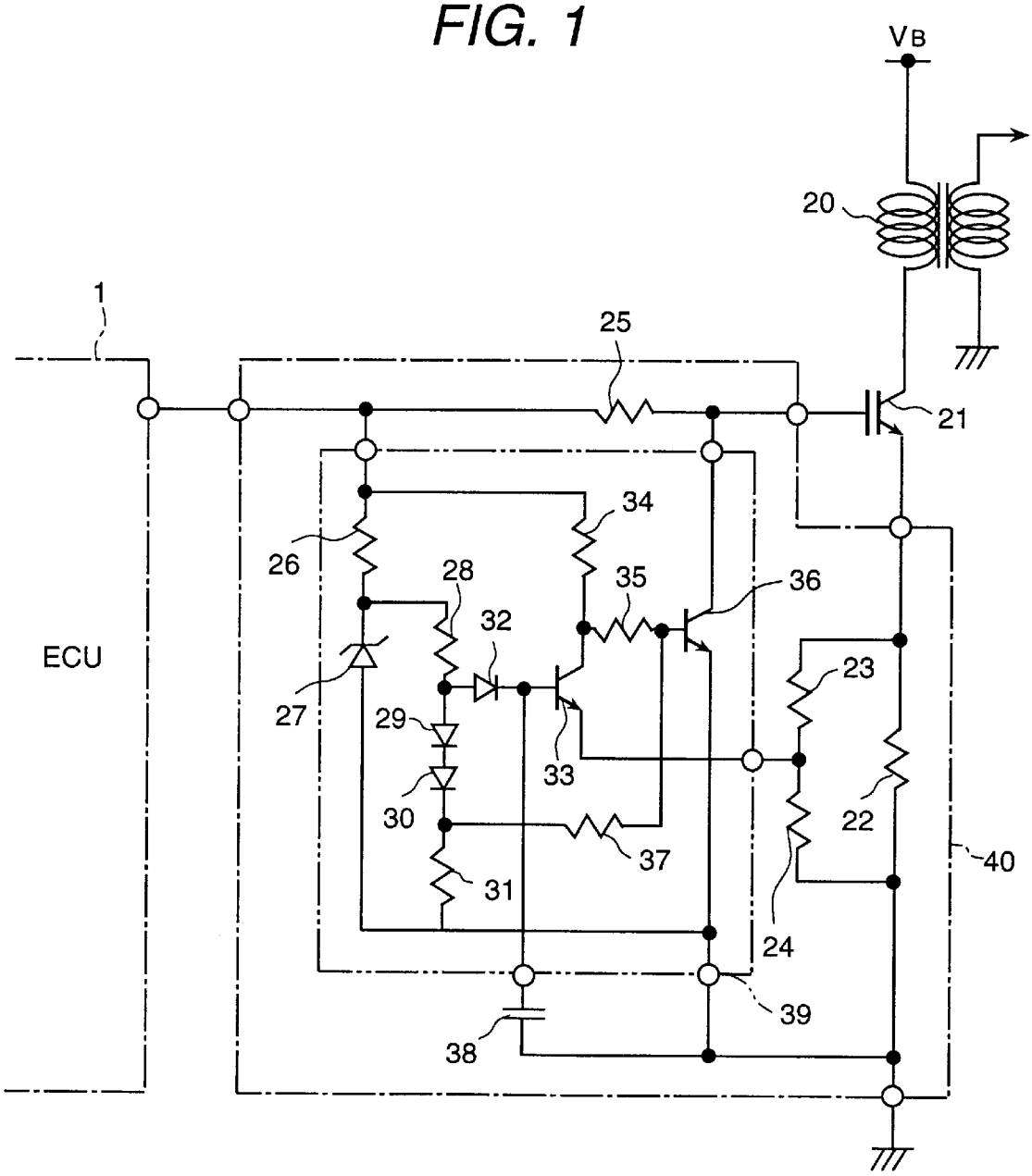
FIG. 1 shows the circuit arrangement of an ignition apparatus for an internal combustion engine according to one of embodiments of the present invention.

FIG. 1 shows the circuit arrangement of an ignition apparatus for an internal combustion engine according to one of embodiments of the present invention.

One of the ends of the primary winding of the ignition coil 20 is coupled with one ($V_B$) of terminals of a battery (not shown) and the other end thereof to a collector of IGBT 21, which switches the primary current of the ignition coil 20 on and off. The gate of IGBT 21 is coupled to the hybrid IC 40, which is composed of load resistor 22 for detecting the primary current, resistors 23, 24 connected in series for dividing the voltage drop across the resistor 22, input resistor 25 and condenser 38, as well as current restriction circuit 39 assembled in the form of an IC circuit.

The current restriction circuit 39 has a constant voltage power source circuit utilizing the ignition control signal from ECU 1, which is composed of resistor 26 for separating the signal from ECU 1 and an internal voltage of this circuit and zener diode 27 producing a constant voltage. The voltage drop across the zener diode 27 supplies a current for resistor 31 through resistor 28 and diodes 29, 30. The voltage divided by the resistors 28, 31 as well as the forward voltage drop of the diodes 29, 30 determine the reference voltage in the current restriction circuit 39.

The sum of the voltage drop across the resistor 31 and the forward voltage drop of the diodes 29, 30 is applied to the base of NPN transistor 33 (called a control transistor, hereinafter) through diode 32. Namely, the control transistor 33 is pulled up by resistor 34 and results in the situation that it is biased by the forward voltage drop of the diodes 29, 30 and the voltage across the resistor 31 through the diode 32. One of terminals of the condenser 38 is coupled between the diode 32 and the base of the control transistor 33, and the other terminal thereof is grounded.

Further, it is of course that the series connection of the diode 32 and the transistor 33 can be replaced by a so-called Darlington connection of two transistors, in which there is provided a preceding transistor whose emitter is coupled with the base of the control transistor 33 as a succeeding transistor and collectors of both the transistors are coupled with each other. In that case, the condenser 38 can be connected between the juncture of the emitter of the preceding transistor and the base of the control transistor 33 and ground.

The emitter of the control transistor 33 is coupled with the connecting point of the series connection of the resistors 23, 24, which is connected across the load resistor 22. When the voltage drop across the resistor 24 becomes higher than the base voltage of the transistor 33, the transistor 33 becomes nonconductive. After that, the current having flowed through the transistor 33 so far begins to flow in a base of second transistor 36 through resistor 35, whereby the second transistor 36 becomes conductive. Since feed-back resistor 37 is connected between the resistor 31 and the base of the transistor 36, the voltage drop across the resistor 31 increases as the base potential of the transistor 36 rises.

The voltage drop across the resistor 31 by this feed-back current causes the increased bias voltage of the control transistor 33. Since, however, the bias voltage of the control transistor 33 increases slowly, while charging the condenser 38, the transistor 36 becomes conductive slowly, whereby the current flowing through IGBT 21 is restricted slowly and hence the collector voltage of the IGBT 21 is prevented from jumping and then swinging.

FIGS. 2*a* to 2*f* are diagrams showing waveforms of voltage or current of various parts of the circuit as shown in FIG. 1.

Figures 2A, 2B, 2C, 2D, 2E, 2F:
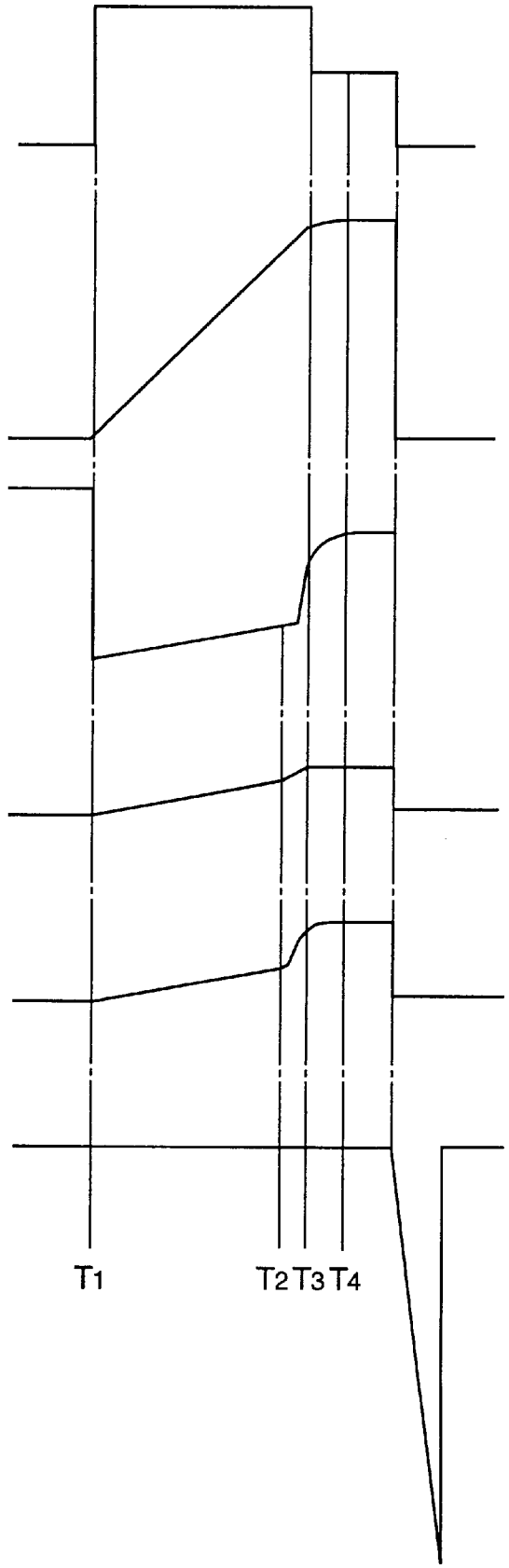
FIGS. 2*a* to 2*f* are diagrams showing waveforms of voltage or current in various parts of the circuit as shown in FIG. 1.

As shown in FIG. 2*a*, the ignition control signal is applied to the gate of IGBT 21 at time point $T_1$, whereby IGBT 21 is made conductive, and the primary current of the ignition coil 20 increases, as shown in FIG. 2*b*. As a result, the voltage between the collector and the emitter of IGBT 21 usually rises by about 2 volts, as shown in FIG. 2*c*, and accordingly the voltage drop across the load resistor 22 increases, as shown in FIG. 2*d*. The potential of the base of the control transistor 33 is lifted by the voltage drop across the load resistor 22, as shown in FIG. 2*c*.

Since the control transistor 33 is turned off in the duration between time points $T_2$ to $T_3$, the base potential of the control transistor 33 is raised by the fed-back voltage through the feed-back resistor 37. However, it becomes stable slowly by the condenser 38 (time points $T_3$ to $T_4$). Then, IGBT 21 becomes active and, as shown in FIG. 2*c*, the collector voltage is stabilized with the same tendency as the base voltage of the control transistor 33, whereby the current restriction is effected slowly and accordingly the jumping or swinging of the primary current, which occurs when the current begins to be restricted, can be suppressed.

Figure 3:
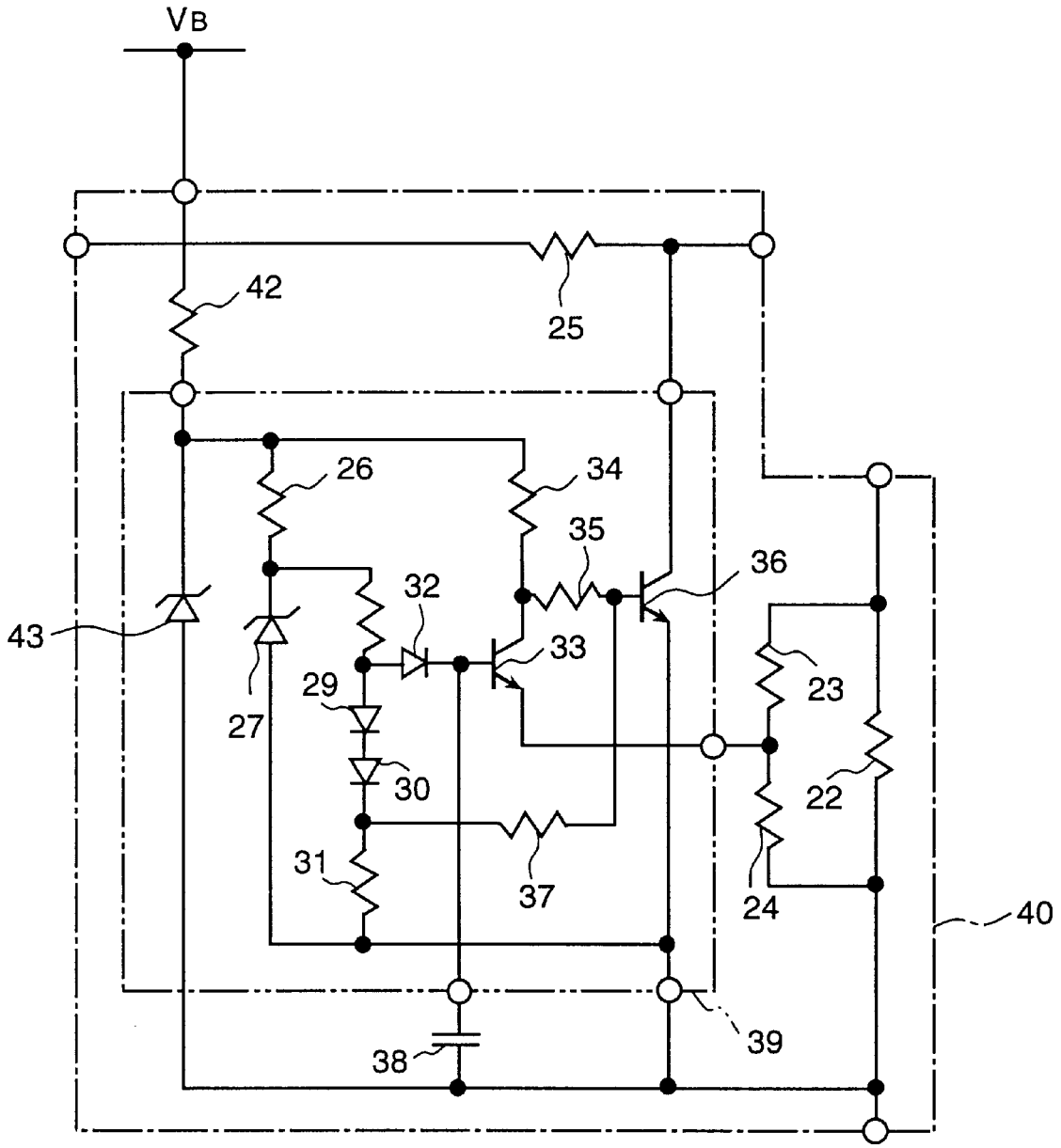
FIG. 3 shows a part of the circuit arrangement of an ignition apparatus according to another embodiment of the present invention.

FIG. 3 shows a part of the circuit arrangement of an ignition apparatus according to another embodiment of the present invention.

In this embodiment, an electric power source for the control circuit is provided by the battery terminal $V_B$. Resistor 42 and zener diode 43 constitutes an electric power source circuit. Since the stable electric power can be provided in this embodiment, the highly accurate control can be achieved. Further, if a gap reference voltage circuit with the high accuracy and the excellent temperature characteristic is used in place of the zener diode 27 as a reference bias, the accuracy and the temperature characteristic is further improved.

Figure 4:
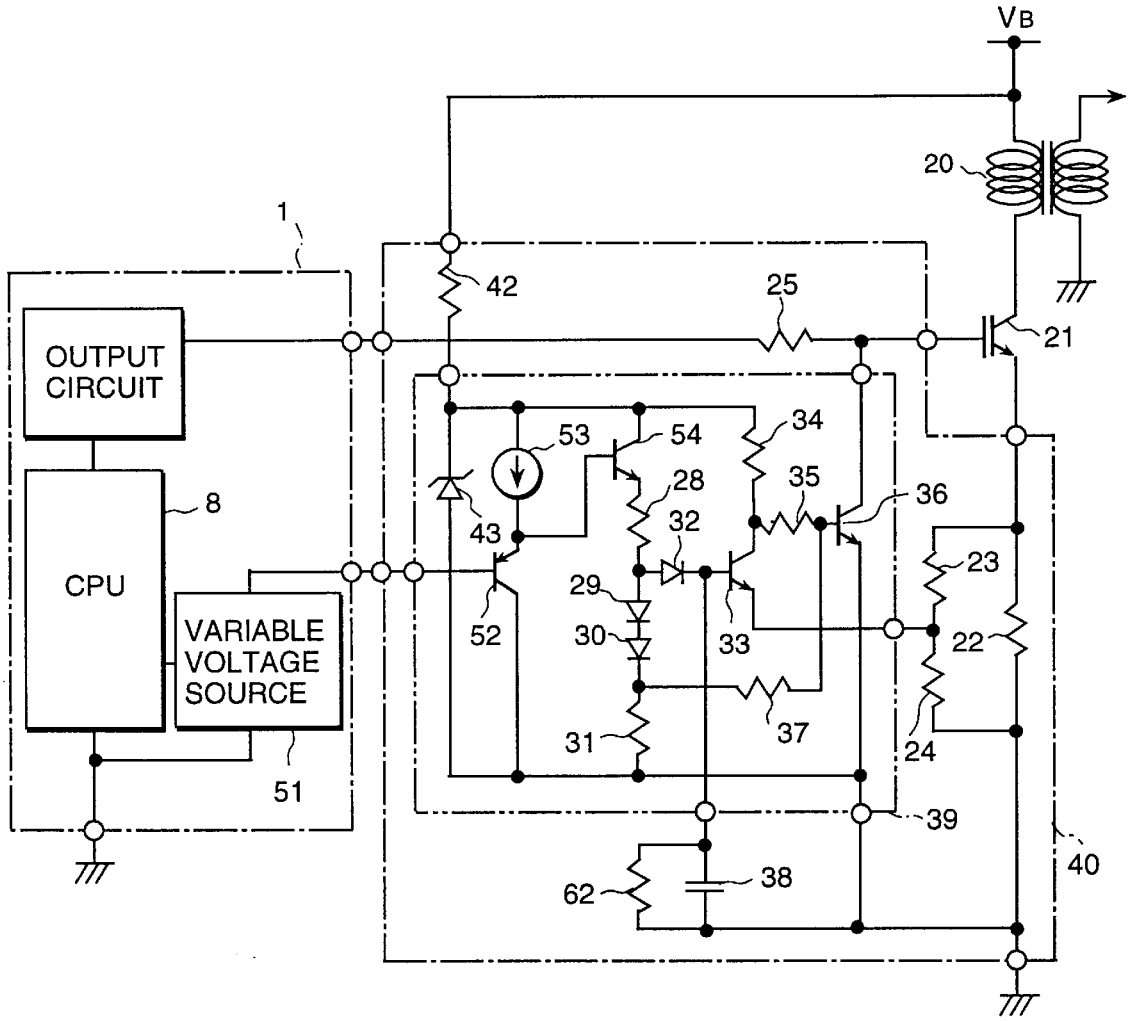
FIG. 4 shows the circuit arrangement of an ignition apparatus according to still another embodiment of the present invention.

FIG. 4 shows the circuit arrangement of an ignition apparatus according to still another embodiment of the present invention.

In this embodiment, ECU 1 is provided with variable voltage source 51, which produces a variable output voltage in accordance with the operating condition of the engine, which is obtained by the calculation in CPU 8. The output of the variable voltage source 51 is applied to the base of the control transistor 33 through the circuit as described later, whereby the primary current of the ignition coil 20 can be controlled and accordingly the maximum value thereof is determined, too. Namely, with this arrangement, the collector current of IGBT 21 can be varied from zero ampere to the saturated value.

That is, in the circuit arrangement as shown, the variable voltage source 51 supplies the bias voltage for the base of PNP transistor 52, whose emitter is coupled with constant current source 53. With this, the emitter potential of the transistor 52 is rose by the constant current source 53 by the voltage corresponding to the base-emitter voltage drop ($V_{BE}$). The emitter of the transistor 52 is further coupled to the base of NPN transistor 54, which forms an emitter follower together with the resistors 28, 31 and the diodes 29, 30.

The potential of the anode of the diode 29 is applied to the base of the control transistor 33 through the diode 32. As a result, the base of the control transistor 33 is biased by the voltage drop across the resistor 31. Between the base of the control transistor 33 and ground, there is provided a parallel connection of the condenser 38 and discharge resistor 62, whereby the change in the collector current of IGBT 21 is moderated.

Further, in this embodiment, since the bias voltage of the control transistor 33 is controllably provided on the side of ECU 1, the limit value of the collector current of IGBT 21 can be varied arbitrarily and slowly. Accordingly, since the collector current of IGBT 21 decreases slowly by the effect of the time constant of the condenser 38 and the resistor 62, the undesirable high voltage is not induced on the secondary side of the ignition coil 20, even when the current flowing through the ignition coil 20 is increased or decreased by varying the current limit value in accordance with the operating condition of the engine, or even when the current is interrupted upon occurrence of an abnormality.

With this, it becomes possible to vary the collector current of IGBT 21 at the arbitrary timing safely in accordance with the operating condition of the engine.

Figure 5:
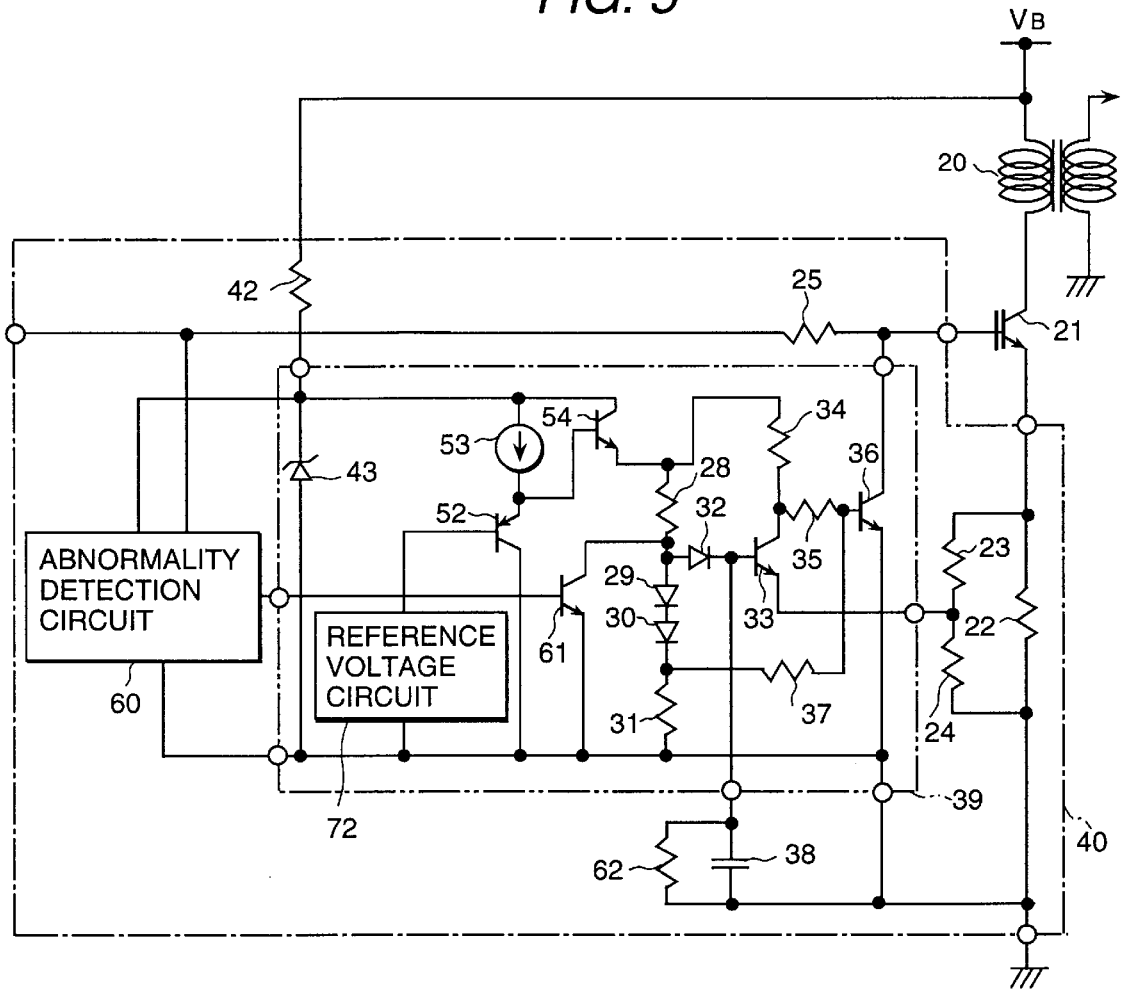
FIG. 5 shows the circuit arrangement of an ignition apparatus according to further embodiment of the present invention.
Figure 6:
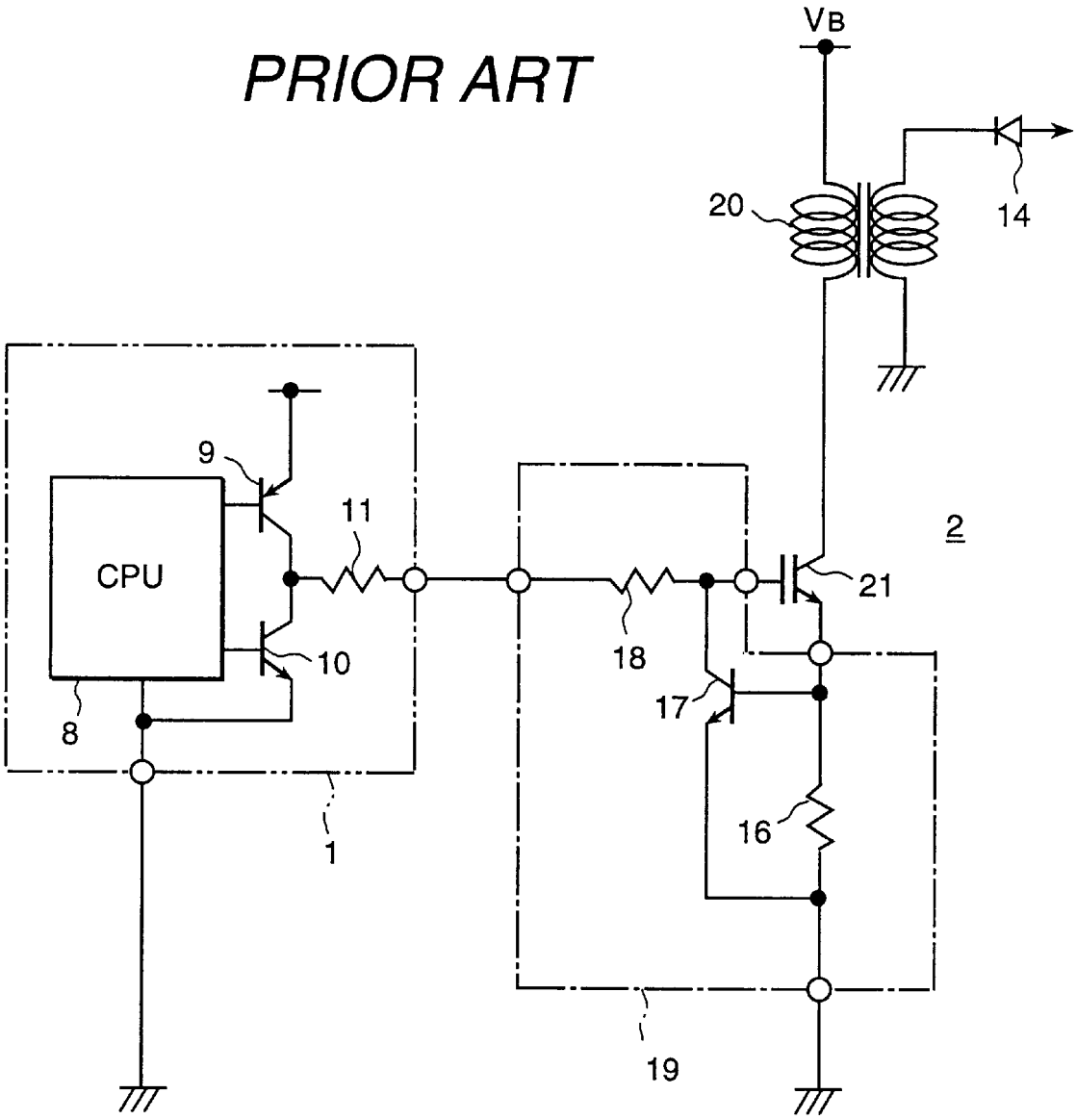
FIG. 6 PRIOR ART
FIG. 6 shows the circuit arrangement of a typical example of a prior art ignition apparatus for an internal combustion engine.
Figures 7A, 7B, 7C, 7D:
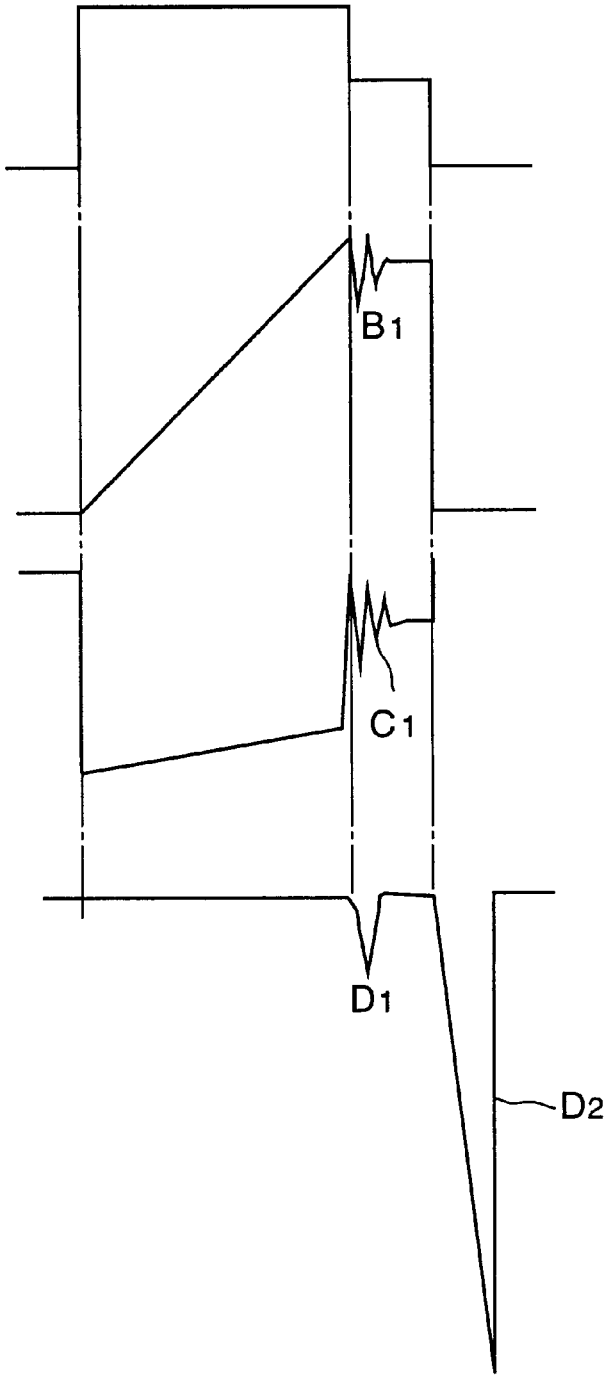
PRIOR ART FIG. 7 a
FIGS. 7*a* to 7*d* are diagrams showing waveforms of voltage or current in various parts of the prior art circuit as shown in FIG. 6.

FIG. 5 shows the circuit arrangement of an ignition apparatus according to further embodiment of the present invention.

The ignition apparatus of this embodiment is provided with an abnormality detection circuit 60, which has a temperature sensing element to detect an abnormal generation of heat within the ignition apparatus and takes the ignition control signal therein to detect the abnormality thereof. When the abnormality is detected, the limit value of the collector current of IGBT 21 is reduced slowly and finally the collector current is made zero. Since there is no sharp change in the current of IGBT 21, i.e., the primary current of the ignition coil 20, the undesirable high voltage is never induced on the secondary side of the ignition coil 20.

In the circuit arrangement of this embodiment, the base of the PNP transistor 52 is biased by reference voltage source 72. The emitter of the PNP transistor 52 is coupled with the base of the NPN transistor 54. The potential of the emitter of the PNP transistor 52 is raised by the base-emitter voltage ($V_{BE}$) by the constant current source 53. The NPN transistor 54 forms the emitter follower together with the resistors 28, 31 and the diodes 29, 30. Since the potential of the anode of the diode 32 is applied to the base of the control transistor 33, the base of the control transistor 33 is biased by the voltage across the resistor 31.

If transistor 61 is made on by an output of the abnormality detection circuit 60, the bias voltage applied to the base of the control transistor 33 is decreased, whereby the limit value of the collector current of IGBT 21 is decreased. Accordingly, the potential of the base of the transistor 33 is decreased slowly by the effect of the time constant of the condenser 38 and the resistor 62 provided between the base of the control transistor 33 and ground. On the other hand, the collector current of the IGBT 21 also varies slowly, and therefore, the undesirable high voltage is not induced on the secondary side of the ignition coil 20.

As will be understood from the foregoing, according to an ignition apparatus for an internal combustion engine according to the present invention, the jump or vibration of the collector voltage of an IGBT used as a switching element can be suppressed, so that a reliable ignition apparatus, which never induces the undesirable high voltage on a secondary winding of an ignition coil, can be realized.

We claim:

1. An ignition apparatus for an internal combustion engine, having:

an ignition coil;

an insulated-gate bipolar transistor for performing the switching control of a primary current of said ignition coil;

an electronic control unit for supplying an ignition control signal to a gate of said insulated-gate bipolar transistor to make said transistor carry out the switching operation; and current control means for restricting the ignition control signal in accordance with the primary current of said ignition coil, wherein said current control means comprises:

a transistor for rendering said insulated-gate bipolar transistor conductive upon occurrence of the ignition control signal, when said transistor is in a low impedance state, said transistor being changed to a high impedance state, when the primary current of said ignition coil reaches a certain value;

a bias circuit for providing a bias voltage to keep a base of said transistor at a predetermined potential, by which said transistor is changed to the low impedance state; and a condenser, which is connected to the base of said transistor and changes the base potential of said transistor with a certain time constant, when said transistor is changed to the high impedance state.

2. The ignition apparatus according to claim 1, wherein said current control means further comprises a second transistor which becomes nonconductive, when said transistor is in the low impedance state, and conductive to ground the gate of said insulated-gate bipolar transistor, when said transistor is in the high impedance state, and a feed-back circuit provided between the base of said second transistor and said bias circuit.

3. The ignition apparatus according to claim 1, wherein an electric power of said current control means is supplied by the ignition control signal.

4. The ignition apparatus according to claim 1, wherein an electric power of said current control means is provided by dividing the voltage of a battery via a series connection of a resistor and a zener diode.

5. The ignition apparatus according to claim 1, wherein the bias voltage is controlled by a variable voltage source generated in said electronic control unit.

6. The ignition apparatus according to claim 1, wherein said ignition apparatus is further provided with an abnormality detection circuit and the bias voltage is controlled by an output of said abnormality detection circuit.

7. The ignition apparatus according to claim 2, wherein an electric power of said current control means is supplied by the ignition control signal.

8. The ignition apparatus according to claim 2, wherein an electric power of said current control means is provided by dividing the voltage of a battery via a series connection of a resistor and a zener diode.

9. The ignition apparatus according to claim 2, wherein the bias voltage is controlled by a variable voltage source generated in said electronic control unit.

10. The ignition apparatus according to claim 2, wherein said ignition apparatus is further provided with an abnormality detection circuit and the bias voltage is controlled by an output of said abnormality detection circuit.

* * * * *